United States Patent [19]

Seo

[11] Patent Number: 4,976,365

[45] Date of Patent: Dec. 11, 1990

[54] PALLET AND CONTAINER INTEGRATED WITH PALLET

[76] Inventor: Dong J. Seo, 7-504, Hong-Jin Apt., Gye San-Dong, Buk-gu, Incheon, Rep. of Korea

[21] Appl. No.: 435,606

[22] Filed: Nov. 13, 1989

[30] Foreign Application Priority Data

Aug. 7, 1989 [KR] Rep. of Korea ..... 11215/89

[51] Int. Cl.[5] ..... B65D 88/00

[52] U.S. Cl. ..... 220/1.5; 220/23.4; 206/386; 206/598; 108/51.1; 108/55.1; 108/64

[58] Field of Search ..... 206/386, 599, 598; 220/23.4, 1.5; 108/51.1, 55.1, 55.3, 64, 56.1, 56.3

[56] References Cited

U.S. PATENT DOCUMENTS

| | | | |
|---|---|---|---|
| 2,465,148 | 3/1949 | Coonen | 108/51.1 |
| 2,468,055 | 4/1949 | Gibler | 108/51.1 |
| 3,511,191 | 5/1970 | Barry, Jr. et al. | 108/51.1 |
| 3,616,957 | 11/1971 | Patton | 220/1.5 |
| 3,703,870 | 11/1972 | Walton | 108/51.1 |
| 3,720,176 | 3/1973 | Munroe | 108/51.1 |
| 3,749,273 | 7/1973 | Wreghitt et al. | 220/23.4 |
| 4,209,183 | 6/1980 | Jones et al. | 108/55.1 |
| 4,344,368 | 8/1982 | Remington et al. | 108/55.3 |
| 4,848,618 | 7/1989 | Yuan et al. | 220/1.5 |

FOREIGN PATENT DOCUMENTS

| | | | |
|---|---|---|---|
| 2408427 | 8/1974 | United Kingdom | 108/55.1 |

*Primary Examiner*—David T. Fidei

*Attorney, Agent, or Firm*—Hill, Van Santen, Steadman & Simpson

[57] ABSTRACT

A pallet which comprises a four sided platform with forklift tine receiving channels disposed at each side of the platform is disclosed. Horizontal surface engaging wheels are disposed on the bottom of the platform for supporting the platform and for enabling the platform to be moved along a horizontal surface. Vertical surface engaging rollers are disposed on the first and the third sides of the platform for preventing frictional engagement of the first and the second sides of the platform with a vertical surface. An automatic connecting and retracting means is positioned at the second side of the platform for enabling the automatic retraction of the connecting and retracting device upon contact of the device with a wall. A coupling apparatus is positioned at the fourth side of the platform for enabling an interconnection of the platform with a second platform having the automatic connecting and retracting device operatively positioned thereon to interconnect with the coupling structure of the platform upon contact with the automatic connecting and retracting device of the second platform to thereafter enable simultaneous movement of the platforms along the horizontal plane.

15 Claims, 7 Drawing Sheets

FIG. 3A
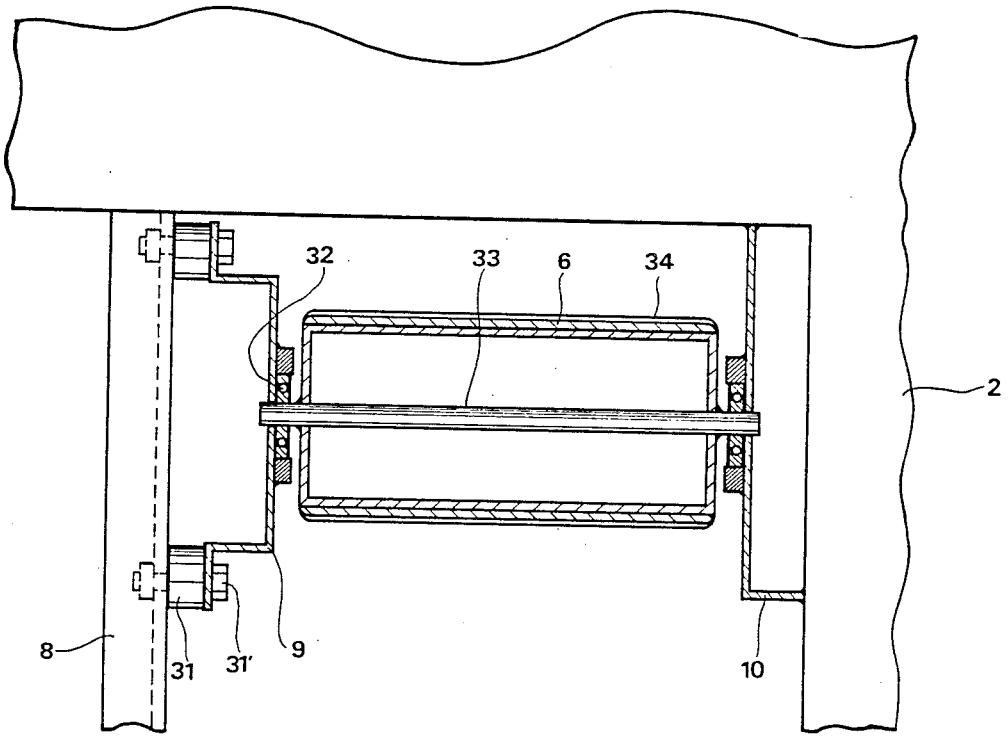
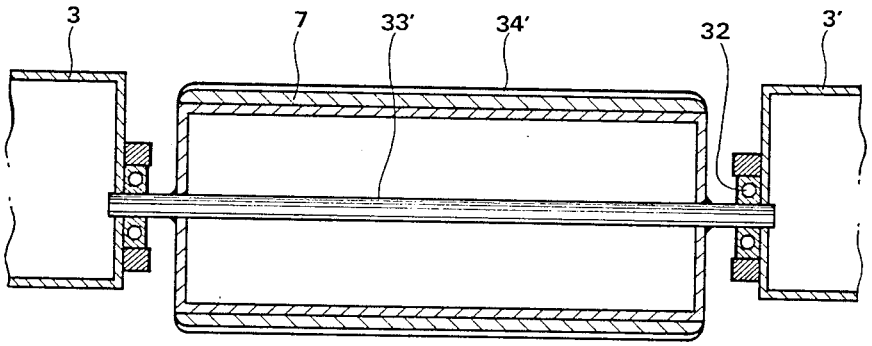
FIG. 3B

FIG. 5A
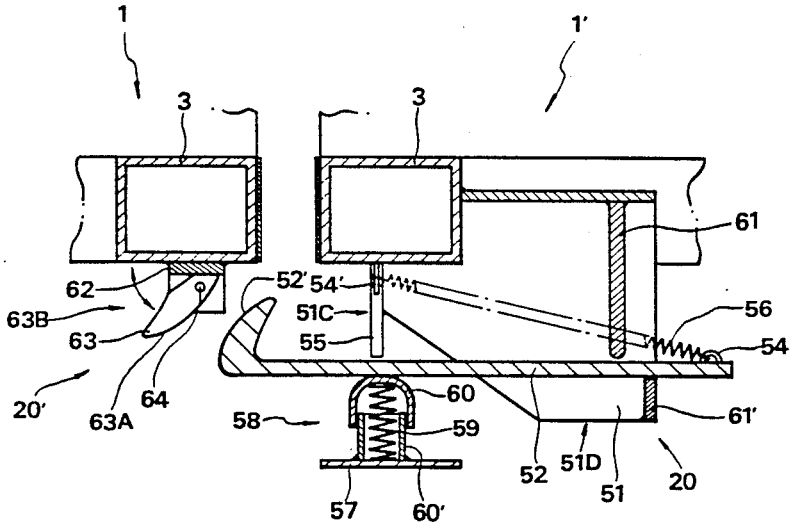
FIG. 5B
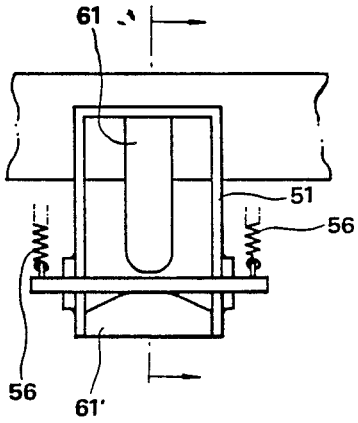
FIG. 5C
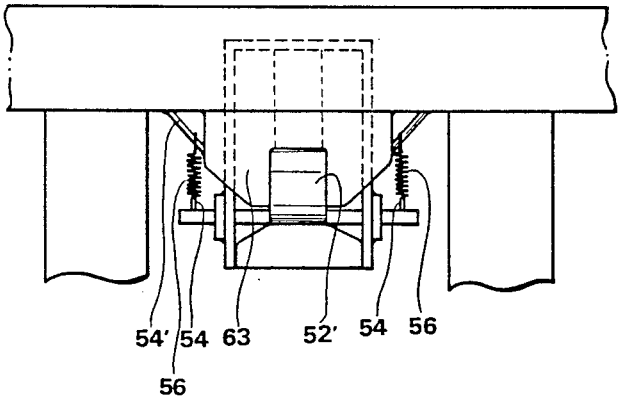
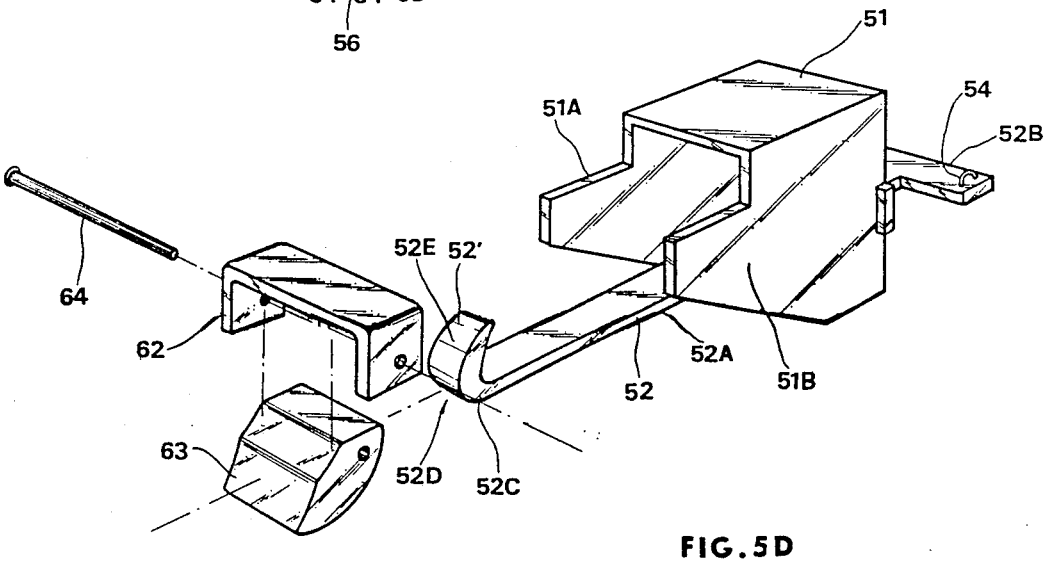
FIG. 5D

FIG. 6A
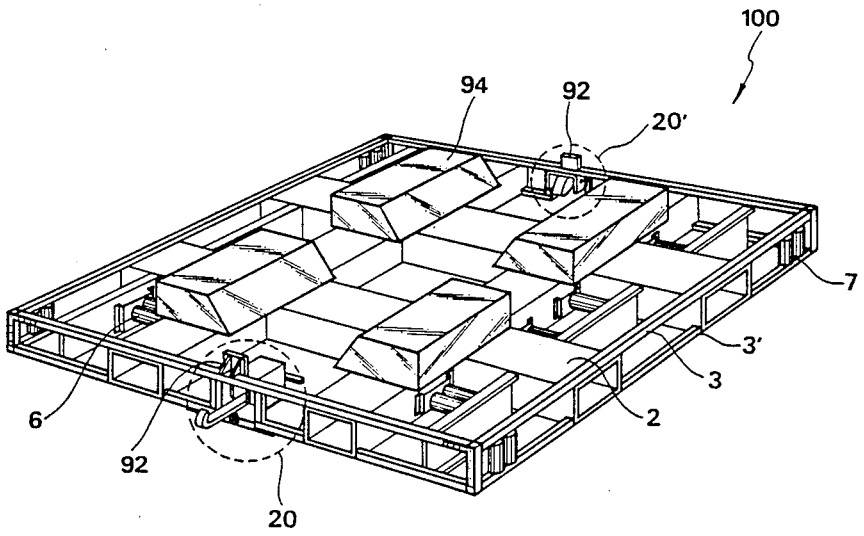
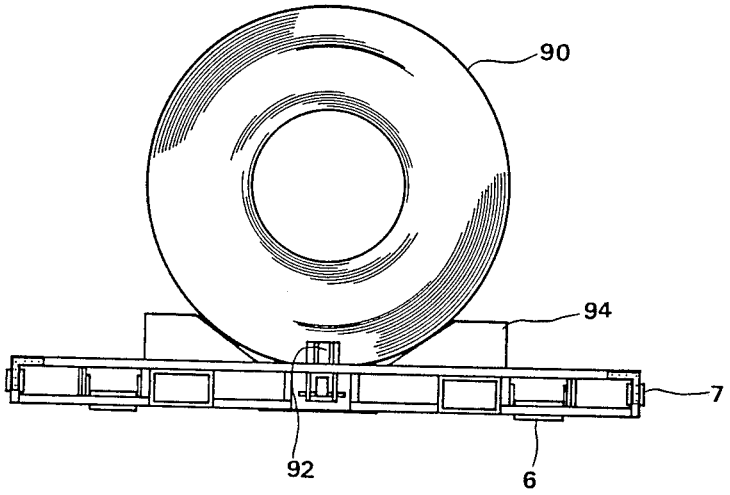
FIG. 6B

FIG. 7
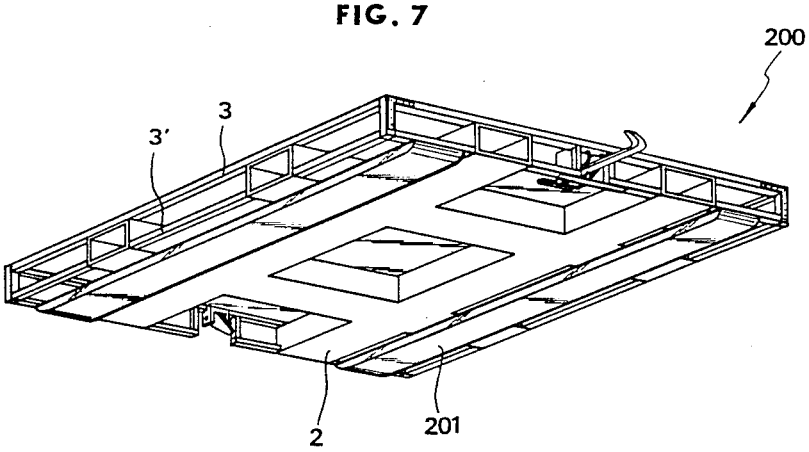
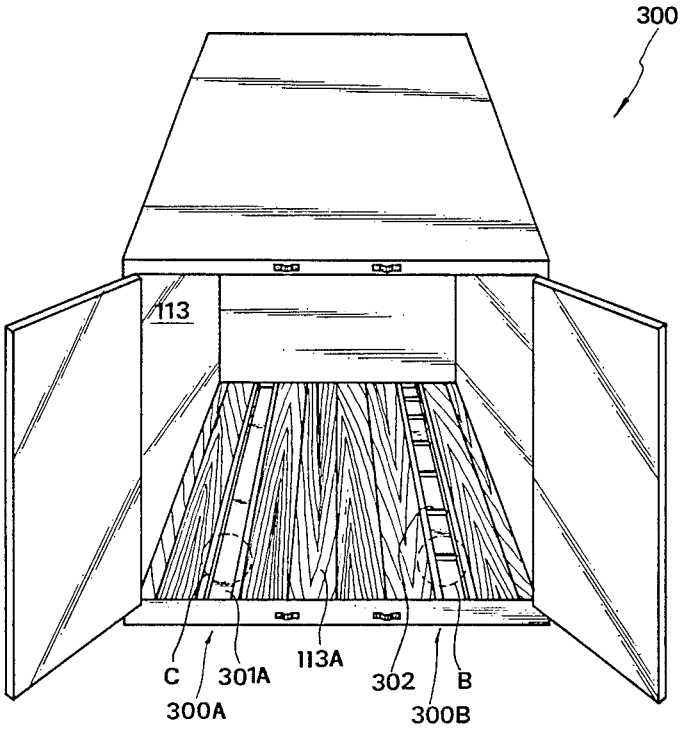
FIG.8A

PALLET AND CONTAINER INTEGRATED WITH PALLET

BACKGROUND OF THE INVENTION

1. Field of the Invention

The present invention relates to a pallet and pallet receiving container, and in particular, to a pallet receiving container system for transportation by land or sea and a pallet with an automatic connection device.

2. Information Disclosure Statement

In general, small containers are used for transportation and storage of cargo, however, because they do not have their own transfer device and connection device, there is a drawback that a forklift has to go into the inside of a large container (hereinafter referred to as "pallet receiving containers") to load small containers therein. It is inefficient and time consuming for a forklift to go into the pallet receiving container to load or remove small containers.

Furthermore, when heavy cargo is loaded into small containers a large forklift must be employed to go into the pallet receiving container which causes damage to the pallet receiving container because of the combined weight of the fork-lift and the small container.

Because of such damage to large containers, a small container and pallet are required which can be easily loaded into or drawn out of large containers by a forklift from outside of the large containers.

The present invention is intended to solve the above described problems and to provide small containers which makes it easy to load and unload small containers or pallets into or from large container.

BRIEF SUMMARY OF THE INVENTION

The invention may be summarized as a pallet which comprises a platform for supporting articles thereon. The platform has a top, a bottom and a first, a second, a third and a fourth side with the first and third sides and the second and fourth sides being parallel relative to each other to define a four sided platform. A first and a second forklift tine receiving channel is disposed at each side of the platform for receiving in use the tines of a forklift from any side of the platform to enable movement of the pallet by a forklift.

A plurality of horizontal surface engaging wheels is disposed on the bottom of the platform for supporting in use the platform and articles placed thereon and for enabling the platform to be moved along a horizontal surface upon rotation of the plurality of horizontal surface engaging wheels. A plurality of vertical surface engaging rollers is disposed on the first and the third sides of the platform for preventing frictional engagement of the first and the third sides of the platform with a vertical surface upon rotation of the rollers upon contact with the vertical surface thereby enhancing movement of the platform in the horizontal plane when the vertical surface engaging rollers engage the vertical surface, such as the walls of a pallet receiving container, warehouse, or the like.

Preferably, the platform includes an automatic connecting and retracting means and a coupling means which cooperate, in use, to automatically connect together pallets having such means to enable the interconnected pallets to be moved along a horizontal plane upon the movement of one of the interconnected pallets. Horizontal plane as used herein includes a loading dock, a pallet supporting floor of a pallet receiving container, and the like. The automatic connecting and retracting means is positioned at the second side of the platform for enabling the retraction of the automatic connecting and retracting means to aid in preventing damage to both the automatic connecting and retracting means of the pallet and the vertical surface by the automatic connecting and retracting means upon contact of the automatic connecting and retracting means with the vertical surface, such as the end wall of a pallet receiving container or the wall of a warehouse. The coupling means is positioned at the fourth side of the platform for enabling an interconnection of the pallet with a second pallet having an automatic connecting and retracting means operatively positioned thereon to interconnect with the coupling means of the pallet upon contact with the automatic connecting and retracting means of the second pallet. Once interconnected, simultaneous movement of the pallets along the horizontal plane may be accomplished by the movement of one of the pallets.

An enclosed container box is preferably positioned on and secured to the top of the platform for receiving and protecting articles positioned within the container box.

A first embodiment of the automatic connecting and retracting means and coupling means is described below. The automatic connecting and retracting means comprises a pair of support plates which are spaced apart relative to each other and are secured to the bottom of the platform. A connection member having a first end a second end with an elongated bore formed between the first and the second ends is utilized. The connection member is positioned between the support plates and pivotally and slidably secured to each of the support plates through the bore such that in use the connection member may pivot and slide along the elongated bore relative to the support plates. The first end of the connection member defines a hook having an inclined face. The connection member extends beyond the edge of the platform and in order to reach the coupling means (described below) and is biased in both an upward direction and in an outward direction relative to the platform and edge of the platform, respectively, to enable in use the retraction of the connection member upon contact of the first end of the connection member with the vertical surface to aid in preventing damage to both the connection member and the vertical surface by the connection member. The coupling means comprises a joint projection having an inclined face for slidably receiving the inclined face of the hook and a back portion for securely receiving the hook of the connection member. A vertical movement stopper is secured to the bottom of the platform such that in use vertical movement of the connection member is limited thereby maintaining vertical alignment of the connection member with the joint projection positioned on a second pallet. The joint projection extends downwardly relative to the bottom of the second platform with the joint projection being secured to the bottom of the second platform such that in use the inclined face of the hook contacts the inclined face of the joint projection and slidably pivots downwardly along the inclined face of the joint projection to the back of the joint projection whereupon the connection member pivots upwardly to securely interconnect the pallet with the second pallet to enable simultaneous movement of the pallets along the horizontal plane.

In a further embodiment of the automatic connecting and retracting means and coupling means, the automatic connecting and retracting means comprises a pair of support plates spaced apart relative to each other and secured to the bottom of the platform with the support plates having a first section and a second section. A "T" shaped connection member has a body portion and an arm portion with the body portion of the "T" shaped connection member positioned between the support plates and with the arm portion extending to contact each supporting plate such that in use the distance the support plates are spaced apart is less than the length of the arm portion thereby stopping or limiting entry of the "T" shaped connection member between the support plates. The body portion of the "T" shaped connection member has a terminal end which defines a hook which has an inclined face. The "T" shaped connection member is biased in an upward direction and in an outward direction relative to the platform and the edge of the platform, respectively, to enable the retraction of the "T" shaped connection member upon contact of the terminal end of the "T" shaped connection member with a vertical surface to thereby aid in preventing damage to both the "T" shaped connection member and the vertical surface by the "T" shaped connection member. The coupling means comprises a joint piece which is pivotally secured to the fourth side of the second pallet with the joint piece has an inclined face for slidably receiving the inclined face of the hook and a back for securely receiving in use the hook. The first and the second sections of the support plates each further include a first and a second vertical movement stopper, respectively, for limiting the vertical movement of the "T" shaped member thereby vertically aligning the "T" shaped connection member with the joint piece on the second platform. The joint piece extends downwardly relative to the bottom of the second platform such that in use when the inclined face of the hook contacts the inclined face of the joint piece, the joint piece pivots and slides along the inclined face of the hook to the back of the hook whereupon the joint piece pivots downwardly to securely interconnect the pallet with the second pallet to enable simultaneous movement of the pallets along the horizontal plane.

The invention further includes a pallet system which comprises a pallet comprising a platform for supporting articles thereon and having a top, a bottom and a first, a second, a third and a fourth side with the first and third sides and the second and fourth sides being parallel relative to each other to define a four sided platform. A plurality of horizontal surface engaging wheels are disposed on the bottom of the platform along a line parallel to the first side of the platform and along a line parallel to the third side of the platform for supporting in use the platform and the articles placed thereon. The plurality of horizontal surface engaging wheels enable the platform to be moved along a horizontal surface in a straight line motion upon only rotation of the plurality of horizontal surface engaging wheels. A first and a second forklift tine receiving channel are disposed at each side of the platform of the pallet for receiving in use the tines of a forklift to enable movement of the pallet by a forklift. A pallet receiving container which comprises a supporting floor having a first and a second pallet wheel receiving groove, respectively, are formed in the pallet supporting floor in a parallel and spaced apart manner relative to one another. This configuration is to enable, in use, the plurality of horizontal surface engaging wheels disposed on the bottom of the platform along the line parallel to the first side of the platform and along the line parallel to the third side of the platform to be each guidably received into the first and second pallet wheel receiving groove formed in the pallet supporting floor of the pallet receiving container, respectively, thereby preventing lateral movement of the platform relative to the floor when the plurality of horizontal surface engaging wheels have been received into the first and the second pallet wheels receiving grooves.

An enclosed container box is preferably positioned on and secured to the top of the platform for receiving and protecting articles positioned within the container box.

The invention further includes a pallet system which comprises a pallet comprising a platform for supporting articles thereon and having a top, a bottom and a first, a second, a third and a fourth side with the first and third sides and the second and fourth sides being parallel relative to each other to define a four sided platform. A first and a second pallet skid are positioned on the bottom of the platform in a parallel and spaced apart manner relative to one another for supporting in use the platform and articles placed thereon. A first and a second forklift tine receiving channel are disposed at each side of the platform of the pallet for receiving in use the tines of a forklift to enable movement of the pallet by a forklift. A pallet receiving container is utilized. The pallet receiving container comprises a supporting floor having a first and a second pallet skid receiving groove formed in the pallet supporting floor. Each skid receiving groove is slightly larger in width than the width of each pallet skid. This configuration enables each pallet skid to be slidably received and receptively guided into the first and the second skid receiving groove, respectively, formed in the pallet supporting floor of the pallet receiving container and prevents lateral movement of the platform relative to the floor when the pallet skids have been received into the skid receiving grooves.

An enclosed container box is preferably positioned on and secured to the top of the platform for receiving and protecting articles positioned within the container box.

Each skid receiving groove may further include a plurality of rollers for rotatably supporting the first and the second skids respectively and for aiding in use the platform to be moved along a horizontal surface of the pallet supporting floor upon rotation of the plurality of rollers.

The pallet system preferably includes an automatic connecting and retracting means positioned at the second side of the platform and a coupling means positioned at the fourth side of the platform. The automatic connecting and retracting means enables the retraction of the automatic connecting and retracting means thereby aiding in preventing damage to both the automatic connecting and retracting means of the platform and the vertical surface by the automatic connecting and retracting means upon contact of the automatic connecting and retracting means with the vertical surface.

The coupling means is positioned at the fourth side of the platform for enabling in use an interconnection of a first pallet with a second pallet of the plurality of pallets having an automatic connecting and retracting means operatively positioned thereon to interconnect with the coupling means of the first pallet upon contact with the automatic connecting and retracting means of the second pallet to enable simultaneous movement of the pallets along the pallet supporting floor of the pallet receiving container.

The pallet receiving container, preferably, receives, in use, a plurality of pallets. The pallet receiving container comprises a supporting floor having a first and a second pallet skid receiving groove, respectively, formed in the pallet supporting floor. Each skid receiving groove is slightly larger in width than the width of each pallet skid of the plurality of pallets such that in use each pallet skid is slidably received and receptively guided into the first and the second skid receiving groove, respectively, formed in the pallet supporting floor of the pallet receiving container thereby preventing lateral movement of the platform relative to the floor when the pallet skids have been received into the skid receiving grooves. The skid receiving groove of the pallet receiving container preferably includes a plurality of roller.

An enclosed container box is preferably positioned on and secured to the top of the platform for receiving and protecting articles positioned within the container box.

One of the embodiments of the automatic connecting-retracting means and coupling means as described above are preferably disposed on each pallet of the pallet system to enable the pallets to be easily removed from the pallet container containing a plurality of pallets or moved along a loading dock.

A pallet receiving container having I-shaped transverse members which lie across the bottom of the pallet receiving container in certain spacing, for loading and transporting a plurality of small containers, characterized in that guide plate, floor board and the I-shaped transverse member are integrated by penetrating them with a plurality of tapping screw at both sides of a cutting section, after inserting a pair of channel shaped guide plates of metal material longitudinally into the cutting section which is formed by cutting a floor board to have certain breadth and depth corresponding to a bottom roller of a pallet on the bottom of the pallet receiving container.

Hereafter the present invention is described in detail with reference to the attached drawings.

BRIEF DESCRIPTION OF THE DRAWINGS

FIG. 3A illustrates in planar section the construction of the horizontal surface engaging wheel used in the present invention;

FIG. 3B illustrates in planar section the construction of the vertical surface engaging roller used in the present invention;

FIG. 5A illustrates in section the construction of the T type automatic connecting and retracting means and coupling means;

FIG. 5B shows the back of the means of FIG. 5A;

FIG. 5C shows the front view of the automatic connecting and retracting means of FIG. 5A;

FIG. 5D shows the perspective view of the means of FIG. 5A with parts disassembled;

FIG. 6A shows the perspective view of the pallet of FIG. 1; FIG. 6B shows the front view of the pallet;

FIG. 7 shows the perspective view of the bottom of the second embodiment of the pallet;

FIG. 8A shows the perspective view of the inside of pallet receiving container;

DETAILED DESCRIPTION OF THE DRAWINGS

Figure 1:
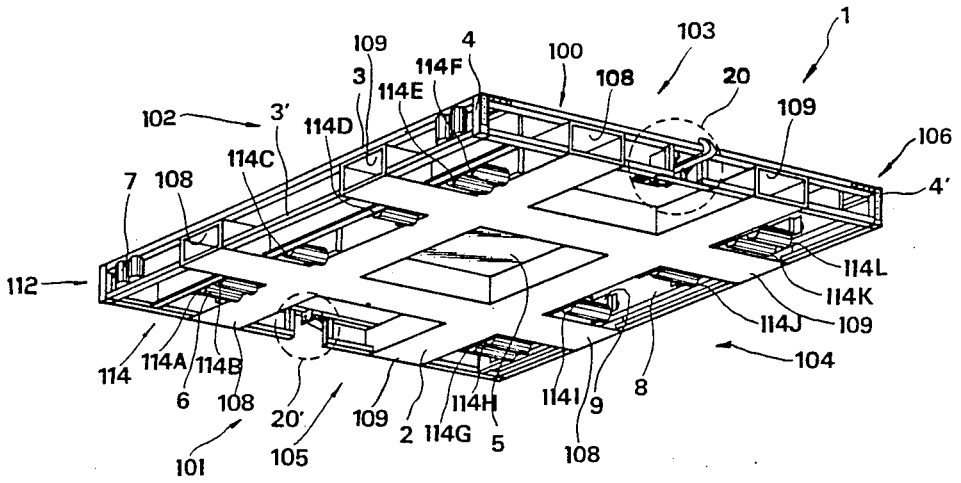
FIG. 1 shows a perspective view of the bottom of the pallet in accordance with the present invention.

FIG. 1 is a perspective view of the bottom of the pallet which can be loaded into the pallet receiving container according to the present invention.

Figure 4A:
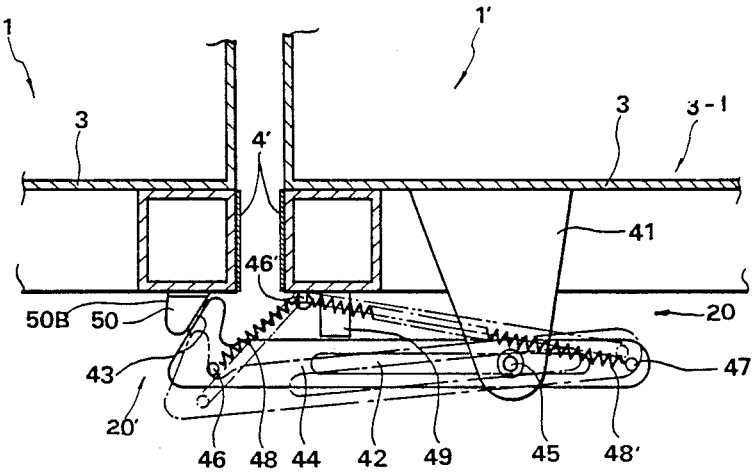
FIG. 4A illustrates in section the construction of the elongated aperture type automatic connecting and retracting means and coupling means.

The pallet comprises a platform 2 for supporting articles thereon and having a top 100, a bottom 101 and a first 102, a second 103, a third 104 and a fourth 105 side with said first and third sides and said second and fourth sides being parallel relative to each other to define a four sided platform 106. The first 108 and second 109 forklift tine receiving channels are disposed at each side 102, 103, 104, 105 of the platform 2 for receiving in use the tines of a forklift (not shown) to enable movement of the pallet by a forklift. The plurality of horizontal surface engaging wheels 114 are disposed on the bottom 101 of the platform 2 for supporting in use the platform and articles placed thereon. The plurality of horizontal surface engaging wheels 114 comprise wheels 114A–114F and 114G–114L positioned on the bottom 101 of the platform 2 along a line parallel to the first side 102 and the third side 104, respectively. Preferably, the wheels 114A–114L rotate in a single plane, i.e. each wheel rotates about a fixed horizontal axle, such as 33, to ensure that the pallet follows a straight line when moved along a horizontal plane. The plurality of vertical surface engaging rollers 112 are disposed on the first and the third sides of the platform 2. The automatic connecting and retracting means 20 is positioned at the second side 103 of the platform. The coupling means 20' is positioned at the fourth side 105 of the platform for enabling in use an interconnection of the pallet 1 with a second pallet 1' having an automatic connecting and retracting means operatively positioned thereon, as shown at FIG. 4A.

A detailed configuration of the pallet according to the present invention includes an upper square pipe 3 in the form of square band is welded to the upper end of a platform 2 in the form of # in such a way that the pipe 3 is in line with the end of forklift tine receiving channel 2', the platform 2 being of certain thickness, and having a pair of forklift tine receiving channel 2' on each side.

The ends of upper square pipe 3 in each side are connected to each other by means of joint bar 4, and on the upper part of the platform 2. A Wood Plate 5 is mounted which is received in the upper square pipe and in the same level as the upper square pipe 3.

On the lower end of the platform 2 a lower square pipe 3' is welded to be in line with the bottom surface of the platform 2, the welding being done between the forklift tine receiving channel 2' and joint bar 4 on four corners to give a complete construction of the pallet 1. Both fore and aft sides of the upper square pipe 3 and the joint bar 4 have rubbers 4' attached on them, the rubber being intended to reduce an impact occurring during contact between the pallets 1.

A wheel support 8 in the form of a channel is welded to the platform 2 and to the upper and the lower square pipe 3, 3' longitudinally in the spaces on both sides of the bottom of the platform 2. A wheel fixing die 9 is bolted to the channel shaped wheel support 8. An angle shaped wheel support 10 is welded to the surface of the support 2 corresponding to the wheel fixing die 9. A plurality of horizontal surface engaging wheels 6 are fitted between the roller fixing die 9 and the angle shaped wheel support 10. A plurality of vertical surface engaging rollers 7 are fitted between the upper and the lower square pipes on both sides of the platform 2.

In the middle of the fore and aft ends of the Pallet 1 is provided automatic connecting and retracting means 20 and coupling means 20' capable of connecting small containers when a plurality of them are loaded into pallet receiving containers.

Figure 2:
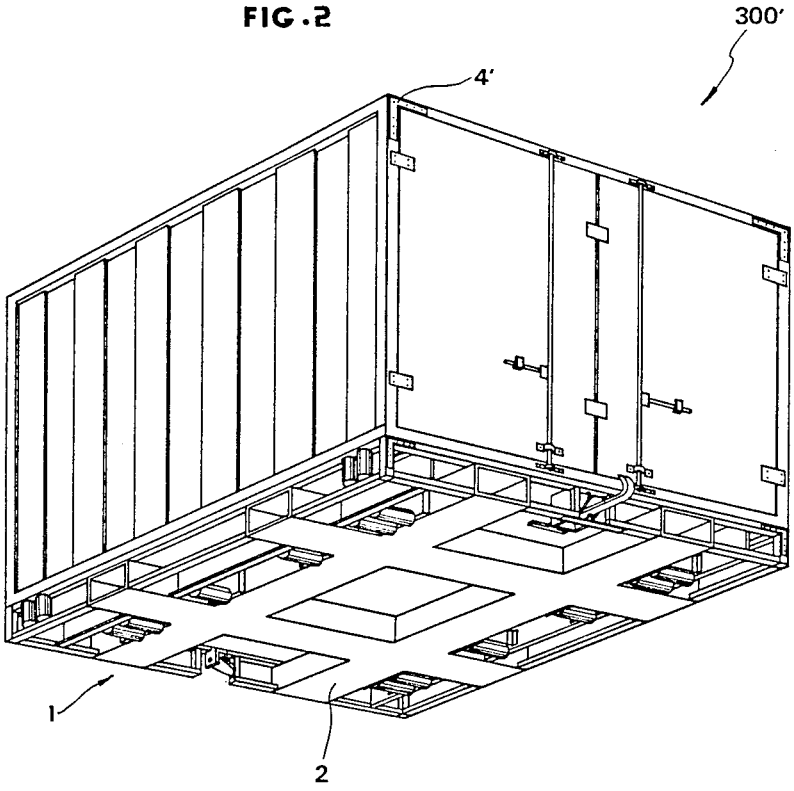
FIG. 2 shows a perspective view of the bottom of the container with pallet integrated on the bottom of the container.

FIG. 2 is a perspective view of the bottom of the pallet 1 with a container 300' integrated on the top of the pallet 1.

The platform 2 of the Pallet 1 shown in FIG. 1 has same size as that of small containers 300'.

The pallet receiving container 300 also can be loaded with and transport a plurality of small containers integrally attached to the upper part of the pallets 1 and with and transport a plurality of pallets which can be loaded with cargo, or a combination thereof. Through proper design of small containers to fit the inside size of the pallet receiving containers, the impacts received during transportation on the fore and aft ends of the pallet receiving containers and the small containers can be minimized by minimizing the spaces longitudinal of the pallet receiving container when certain numbers of small containers are loaded into the pallet receiving container. In this case, it may be efficient to attach the impact reducing rubbers 4' onto corners of small containers to lessen impacts received during loading, unloading and transporting of the pallet receiving container.

FIG. 3A illustrates in planar section the construction of the horizontal surface engaging wheel used as transfer device for the pallet. The wheel fixing die 9 is bolted to the side of the channel shaped wheel support 8 welded to the platform 2 utilizing a bolting member 31 and bolts 31'. The horizontal surface engaging wheel 6 is installed between the wheel fixing die 9 and the angle shaped wheel support 10 after the angle shaped wheel support 10 is welded to the platform 2 corresponding to the wheel fixing die 9. After bearing 32 is fixed to the wheel fixing die 9 and the angle shaped wheel support 10, the shaft 33 integrally fitted with the horizontal surface engaging wheel 6 is inserted into the bearing 32 so that the horizontal surface engaging wheel 6 is rotatable about the shaft 33 to permit the pallet to move along a single direction, i.e., the wheels do not pivot about a vertical axis.

The wheel fixing die 9 is bolted to the channel shaped wheel support 8 because the horizontal surface engaging wheel 6 is readily displaced when the wheel fixing die 9 is separated through disassembling the bolt 31' and removing the bolting member in case the horizontal surface engaging wheel 6 or the bearing 32 wears.

The rubber 34 is coated to the periphery of the horizontal surface engaging wheel 6 so that the impact due to the contact between the horizontal surface engaging wheel 6 and the related inside surface of the pallet receiving container is reduced presenting a favorable effect in view of the prevention of the bottom damage and the extended life of the roller.

The vertical surface engaging roller 7 shown in FIG. 3B is installed between the upper and the lower square pipes 3, 3' provided on both sides of the pallet 1 shown in FIG. 1 the roller is shown with the shaft horizontal for convenience which gives aid to the horizontal surface engaging wheel 6 in transfer by eliminating the friction between the inner side of the pallet receiving container and the outer side of the small container. The bearing 32 is fixed to the corresponding places in the upper and the lower square pipes 3, 3', and then, both ends of the shaft 33' integrally fitted on the vertical surface engaging roller 7 are inserted into each bearing 32 so that the vertical surface engaging roller 7 is rotatable.

The peripheral surface of the vertical surface engaging roller 7 is coated with the rubber 34' in the same way as for the bottom roller 6. The horizontal surface engaging wheels and vertical surface engaging rollers 6, 7 are positioned to outwardly project a certain distance from the surfaces of the upper and the bottom square pipes 3, 3' and the platform 2 so that the horizontal surface engaging wheels and vertical surface engaging rollers 6, 7, are able to rotate when in contact with the bottom 113A and the side 113 of the pallet receiving container 300.

The automatic connecting and retracting means 20 and coupling means 20' is preferably mounted on the middle of the second 103 and fourth 104 side, respectively, of the platform 2 of the pallet 1 as shown in FIG. 1. These means 20, 20' are illustrated in greater detail at FIG. 4A, in which the joint projection is welded to the upper square pipe and the elongated aperture 42 is formed in the connection member 44, and at FIG. 5A, ("T" type) in which the joint piece 63 can pivot about a pin 64 and the connection member has a "T" shape which does not require the elongated aperture 42.

Figure 4B:
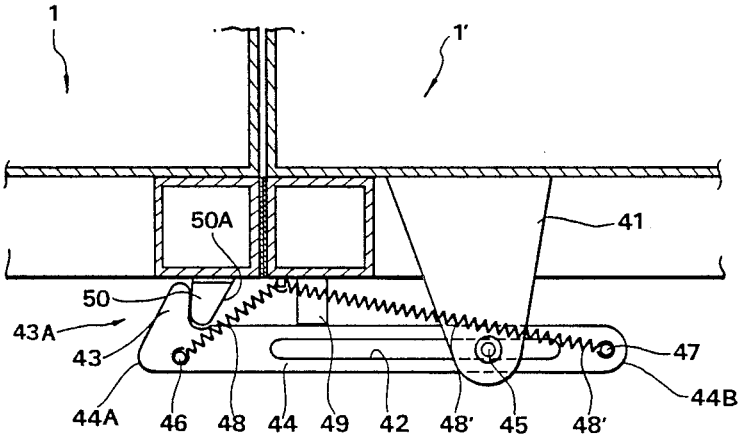
FIG. 4B illustrates in section the construction of the means of FIG. 4A interconnected.
Figure 4C:
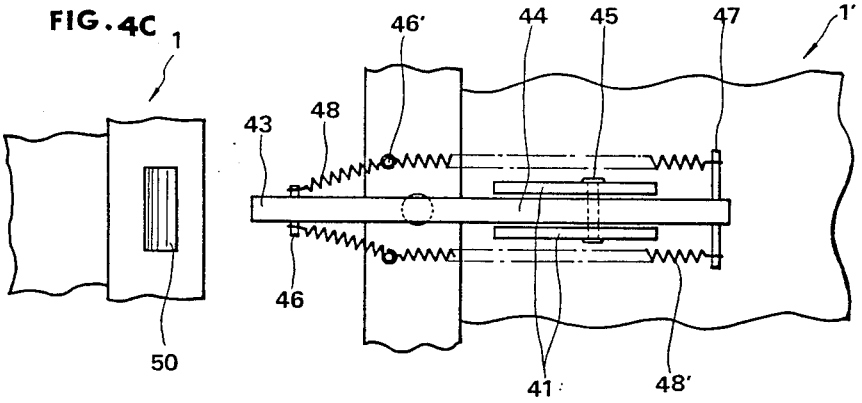
FIG. 4C shows the bottom of the means of FIG. 4A.

FIGS. 4A, 4B and 4C illustrate an embodiment of the automatic connecting and retracting means 20 and coupling means 20' connecting pallet 1 and pallet 1', which are partially illustrated.

A pair of support plates 41 in the form of a reversed triangle is welded to a bottom of a steel plate member 3-1 connected to the upper square pipe 3 welded to the fore part of the pallet 1' in predetermined space relationship. The elongated aperture 42 is formed longitudinally between the first 44A and the second 44B end of the connection member 44. The first end 44A of the connection member 44 defines a hook 43 with an inclined face 43A. The connection member 44 is connected to the pair of the support plates 41 through the elongated aperture 42 by a shaft pin 45. Connection member 44, and especially hook 43, extends beyond the edge of the platform. Connection member 44 is biased in a upward direction and in an outward direction, relative to the platform, by coil springs 48,48'. Coil springs 48,48' are connected between a pin 46' situated at the bottom of the upper sqare pipe 3 and a pin 46 positioned at the first end 44A of connection member 44, proximate the hook 43, and between a rod 47 positioned at the second end 44B of connection member 44 and the pin 46'. A vertical movement stopper 49 of a predetermined length is welded to the bottom of the upper square pipe 3 at a point to contact the middle part of the connection member 44 such that in use the vertical movement of the connection member 44 is limited to the height of the joint projection 50 of another pallet thereby vertically aligning the connection member 44 with the joint projection 50 to permit an interconnection therebetween.

The coupling means 20' comprises a joint projection 50 having an inclined face 50A for slidably receiving the inclined face of hook 43 and a back portion 50B for securely receiving in use the hook of connection member 44. The joint projection is welded to the bottom of the upper square pipe 3 at the fore part of the Pallet 1.

The operation of the present invention provided with rollers, automatic connecting-retracting means and coupling means of the above described construction is explained with reference to FIGS. 2, 4A, 4B and 4C.

Figure 8B:
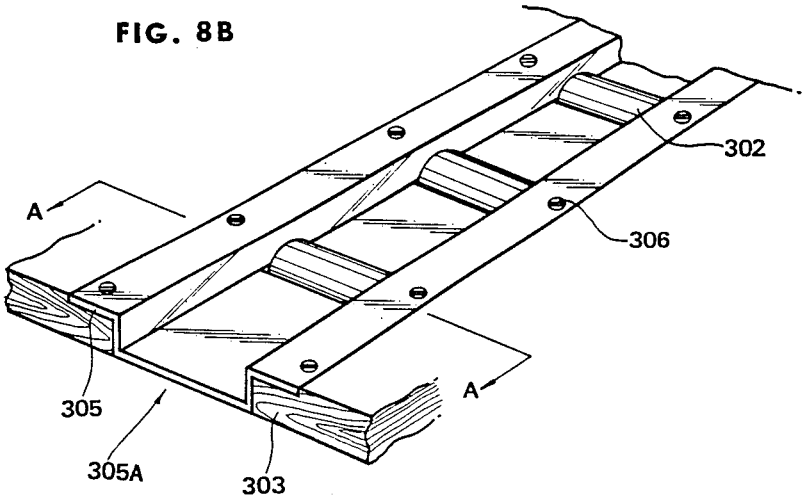
FIG. 8B shows in detail the perspective view of the parts in a circle B in FIG. 8A.
Figure 8C:
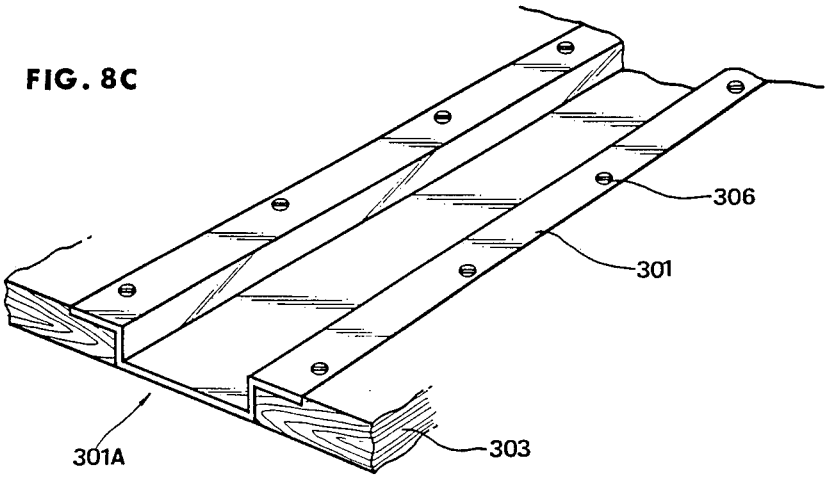
FIG. 8C shows in detail the perspective view of the parts in a circle C in FIG. 8A.

When the small containers 300' are secured or affixed to the bottom of the pallet 1, as shown in FIG. 2, or loaded pallets 1 are placed into the pallet receiving container, the tines of the fork of the forklift are inserted into the forklift tine receiving channels 2' at the fourth side 105 of the Pallet 1 attached to the bottom of the first small container 300', and then the ballet is raised up on moved to the floor in order to have the horizontal surface engaging wheels 6 of the pallet 1 come into contact with the supporting floor or bottom 113A of the pallet receiving container 300, and preferably, the first 301A and second 301B (not shown as a wheel receiving groove at FIG. 8A) pallet wheel receiving grooves, respectively, FIGS. 8A and 8C, which are positioned in the pallet supporting floor in a parallel and spaced apart manner relative to one another such that the plurality of horizontal surface engaging wheels disposed on the bottom of the pallet along the line parallel to the first side of the platform and along the line parallel to the third side of the platform are each guidably received into the first and second pallet wheel receiving groove. The pallet is then pushed into the pallet receiving container 300 by the forklift truck. .

The second small container shown as the second Pallet 1' in FIG. 4A is raised up in the above described way and then pushed so that the aft wall (side 105) of the first small container is in tight contact with the fore wall (side 103) of the second small container, as a result, the inclined part of the joint projection 50 of the Pallet 1 of the first small container interconnects with the inclined part of the hook 43 formed at the first end of the connection member 44 of the Pallet 1' of the second small container as shown by the solid line in FIG. 4A.

When the second small container is pushed into the pallet receiving container with the forklift, the inclined part of the hook 43 of the connection member 44 slides along the inclined surface of the joint projection 50 so as to be pushed down as shown by the broken line in FIG. 4A. At this time, the second end of the connection member moves slightly upward with the shaft pin as a pivot point due to a tensioning force of the tension coil spring 48'. The hook 43 of the first end of the connection member 44 moves downward with the shaft pin 45 as a center along the inclined surface of the joint projection 50 resulting in extension of the fore coil spring 48. The kind of phenomenon takes place because the aft coil spring 48' has a stronger tensioning force than the fore coil spring 48.

If the second small container is pushed further continuously to the first small container so that the hook 43 of the connection member 44 and the joint projection 50 go beyond the contact point, then the hook 43 of the connection member moves upward due to the resilient force of the fore coil spring 48. Now the hook 43 of the connection member 44 hooks the joint projection 50 as shown in FIG. 4B, and as a result, the first small container and the second small container are automatically connected.

Consequently, the second small container is pushed into the pallet receiving container by the forklift with the aid of the side rollers and the bottom wheels, pushing the first small container which were loaded previously further deep into the pallet receiving container.

In the similar manner, a third and a fourth small container can be loaded into the pallet receiving container 300.

By making the width of the joint projection 50 larger than that of the connection member 44, it is possible to connect the small containers even when they are slightly misaligned.

A stopper 49 at the same height as the joint projection 50 prevents the connection member 44 of the coil springs 48, 48' from rising excessively so as to keep the level of the connection member the same as the joint projection 50 in order to enable engagement therebetween.

When the small containers which are connected in series by the connection device are to be drawn out of the pallet receiving container, the fork of the forklift is inserted into the forklift tine receiving channel 2' of the pallet which is situated at the entrance of the pallet receiving container. The pallet is lifted up a bit by the forklift and the forklift is driven back. The small containers which are connected to each other by automatic connection devices according to the present invention are drawn back as far as the fork-lift moves the pallet situated at the entrance of the pallet receiving container. This pallet is then uncoupled from those remaining in the pallet receiving container and moved by the forklift to a predetermined point. The forklift then repeats the process for the next small container which is already situated at the entrance of the pallet receiving container since it was pulled to the entrance upon movement of the first small container.

If the tine of the fork inserted into the forklift tine receiving channel 2' is lowered, the connection member 44 is, due to the stopper 29, above the connection member 44, lowered maintaining the state as shown in FIG. 4B and the hook 43 and the joint projection 50 become free from contact. That is, upon lowering pallet 1', the joint projection 50 automatically uncouples from hook 43 since coil springs 48, 48' in cooperation with aperture 42 allow the hook to slide down the back portion 50B of projection 50. Then the connection member 44 is returned to its original position due to the resilient force of the coil spring 48, 48'.

In case where the second small container the second pallet 1' in FIG. 4A is loaded first into the pallet receiving container, the connection member 44 comes in tight contact with the front wall of the pallet receiving container, and at the same time retreats along the elongated aperture 42, the front wall of the pallet receiving container coming in line with the fore end of the pallet 1' and coming in tight contact with the small container returned by the aft coil spring 48 when being drawn out. The retraction of member 44 also provides an advantage in that valuable space within the container 300 is not taken up by the protrusion of member against a wall, i.e., the entire pallet moves flat against the wall.

Another construction of the automatic connecting-retracting 20 means and coupling means 20' is described below.

FIG. 5A is a sectional view of another embodiment of the automatic connecting and retracting means 20 and coupling means 20'. FIG. 5B is a partial back view of the device of FIG. 5A and FIG. 5C is a partial front view of FIG. 5A. FIG. 5D is an exploded view of the FIG. 5A. The construction and operation of the automatic connecting and retracting means and coupling means is described with reference to the drawings.

After removing a part of the lower square pipe 3' of the middle of the fore end of the pallet 1 as shown in FIGS. 1 and 2, a support member 51 in the form of is secured to the bottom surface of the upper square pipe 3.

A T-shaped connection member 52 is positioned in a "U" shaped member 51 and a first stopper 61 extending through the "U" shaped support member 51 is attached to the aft part or second section 51D of the "U" shaped support member 51 so as to be in contact with the connection member 52.

The "U" shaped support member is secured to the bottom of the platform. The "U" shaped support member has a first leg 51A and a second leg 51B which are spaced apart relative to each other. The "U" shaped support member further includes a first second 51C and a second section 51D. The first 51C and the second 51D sections of the "U" shaped member further include a first 55 and a second 61 vertical movement stopper, respectively, for limiting the upward vertical movement of the "T" shaped member thereby vertically aligning the "T" shaped connection member with the joint piece 63 which is positioned on another pallet. Connection member 52 pivots on member 61' which further maintains the position of member 52 within the "U" shaped member 51.

The "T" shaped connection member 52 has a body portion 52A and an arm 52B with the body portion of the "T" shaped connection member positioned between the first 51A and second 51B legs of the "U" shaped member and with the arm 52B extending to contact each of the first and second legs such that in use the distance the legs are spaced apart is less than the length of the arm thereby preventing entry of the "T" shaped connection member between the first and second legs of the "U" shaped member.

The terminal end 52C of the "T" shaped connection member 52 is given a rounding treatment and forms a curved portion 52' curved upward, i.e., defines a hook 52D having an inclined face 52E. The aft end of the member 52 is provided with a joint ring 54 at each end of the arm 52B.

The upper vertical movement stopper 55 is welded to the bottom of the upper square pipe 3 so as to be in contact with the "T" connection member 52. Also, upper stopper 55 and the both joint rings 54 on arm 52B provide connection points for spings 56.

At the bottom of the "T" connection member 52, a lower support plate 57 is welded to both ends of the bottom of the lower square pipe at the cutting section after the lower square pipe corresponding to the connection member 52 is cut, and on the upper side of the lower support die is welded a lower spring stopper assembly 58 in such a way that the assembly 58 is in contact with the bottom of the connection member 52, refer to part 20 of FIG. 1.

The lower spring stopper assembly 58 biases the "T" shaped connector 52 in an upward direction. The lower spring stopper assembly 58 includes a compression spring 59 in a cylindrical member 60' and has hemispheric cap 60 on it. From the middle of the aft end of another pallet 1 corresponding to the connection member 52 of the construction as such the lower square pipe is removed. Then a joint piece receiving part 62 in the form of channel is welded to the bottom of the upper square pipe 3 and receives a joint piece 63 in it, being attached by means of a pin 64, as see part 20' of FIG. 1.

The aft part, matching the fore part of the connection member 52, of the joint piece 63 is given a rounding treatment, the upper surface being planar and inclined forming an obtuse angle.

In use first, the aft part of the first small container, partly shown as the first pallet 1 in FIG. 5A, loaded in to the pallet receiving container is pushed so as to be in tight contact with the fore part of the second small container, partly shown as the second pallet 1' in FIG. 5A, then the fore surface of the curved portion 52' of the fore end of the connection member 52 comes into contact with the aft surface 63A of the joint piece 63. As the second small container is pushed further, the curved portion 52' pushed against the joint piece 63 which then pivots about pin 64 in an upward direction of the arrow.

When the second pallet 1' is proceeded with the joint piece 63 and the curved portion of the connection member 52 being in contact with each other, the joint piece 63 moves upward a bit and the connection member 52 moves downward due to the contact force of the joint piece 63 and the curved portion 52', applying the compression force on the hemispherical cap 60. In this condition, if the second pallet 1' is proceeded further, the curved portion 52' of the connection member 52 comes into the joint piece receiving part 62 and the joint ring which was rotated upward returns downward due to its weight. Also, the hemispherical cap 60 which was compressed returns to its original position due to the resilient force of the compression spring and as a result, the curved portion 52' of the fore end of the connection member 52 and the joint piece 63 are combined together and the both pallets are connected.

Each stopper 55, 58, 61 maintains the initial state of the connection member 52 by restraining the vertical movement of the member 52. Member 61' provides a pivot point for connection member 52.

Springs 56 bias the "T" connection member 52 in an outward direction and the terminal end of the connection member beyond the edge of the pallet in order the "T" connection member 52 can engage the joint piece 63 of the coupling means 20'. The coupling means comprises a joint piece 63 pivotally secured to the fourth side of the second platform with the joint piece having an inclined face 63A for slidably receiving the inclined face of the hook and a back 63B for securely receiving in use the hook 52D. The first 51C and the second 51D sections of the "U" shaped member 51 each further include a first 55 and a second 61 vertical movement stopper, respectively, for limiting the upward vertical movement of the "T" shaped member thereby vertically aligning the "T" shaped connection member with the joint piece 63.

When separating the "T" connection member 52 from the joint piece 63 which were combined as described above when the second pallet 1' is drawn out from the pallet receiving container, the curved portion 52' of the connection member 52 and the joint piece 63 are released from connection by inserting the fork of the forklift into the fork receiving channels of the second pallet 1', and withdrawing and lowering the fork. The weight of the pallet small container is larger than the friction force exerted between both members, which makes the separation of the connection devices easy.

FIG. 6A and FIG. 6B are perspective view and a front view respectively of the first embodiment of the pallet 1 shown in FIG. 1, which is of construction for loading a roll of steel coil, or the like, 90 onto the top of the platform of the pallet 1.

The construction is same as for the small container in that the vertical surface engaging roller 7, the horizontal surface engaging wheel 6 and the automatic connecting and retracing means and coupling means 20, 20' are provided, but is characterized by two pairs of the fixing members 94 in the form of a wedge positioned longitudinally on the top of the platform of pallet 2.

A stopper 92 for restraining the longitudinal movement of the steel coil 90 caused when the pallet receiving container moves is welded on the fore and the aft end in the middle of the square pipe 3 welded on the upper part of the pallet 100.

The two pairs of the wedge shaped fixing member 94 are, as can be noted from the front section view shown in FIG. 6B, constructed to have a inter surface which has in spaced relationship to fit the outer diameter of the steel coil for receiving the circular steel coil 90 and to have a outer surface which is in right angle to the platform 2.

As shown in FIGS. 1, 6A and 6B, the pallet provided with horizontal surface engaging wheels and vertical surface engaging rollers is usually used when the pallet receiving container has no special structure such as rollers and guide surfaces, etc. on the bottom or side to aid in the placement of the pallet into the receiving container. Alternatively, it is possible to attach the transfer aid means such as rollers and guide surfaces on the bottom of the pallet receiving container instead of attaching the horizontal surface engaging wheels and the vertical surface engaging rollers to the bottom of the pallet.

FIG. 7 is a perspective view of the bottom of the second embodiment of the pallet 1, which utilizes skids 201 of a certain thickness and of the same length, welded to the bottom of the lower square pipe 3' as illustrated at FIG. 7.

As illustrated the fore and the aft ends of the skids 201 are given upward rounding treatment, to provide a slope, to aid in soft contact with the initial roller provided on the bottom of the pallet receiving container.

FIG. 8A shows perspective views of two kinds of the internal structures of the pallet receiving containers which can be loaded with a number of the small containers. For purpose of illustration, the left side of the interior of the pallet receiving container shows the first guide plate 300A, and the right side shows the second guide plate 300B with rollers 302. In actual use both guide plates, 300A,300B, positioned in the pallet receiving container would be either with or without rollers. That is, the second guide plate 300B with rollers 302, also referred to as a skid receiving groove, is the structure used for loading the small container pallet or the pallet to which the skids 201 are attached. Hence, in use, the pallet receiving container includes a first 305A (FIG. 8B) and second 305B (not shown) pallet skid receiving groove, respectively. Whereas, the first guide plate 300A, also referred to as a pallet wheel receiving groove 301A, which is without rollers 302, is the structure used for loading the small container pallet or pallet to which horizontal surface engaging wheels 114 are attached thereby eliminating the need for rollers 302. Hence, in use, the pallet receiving container includes a first 301A and second 301B (FIG. 8C) (not shown) pallet wheel receiving groove, respectively.

The structure of the guide plate 301 on the left side is used for loading the pallets which are provided with the horizontal surface engaging wheels 114 or with small containers which are provided with such wheels 114. Side rollers in this case are not required. That is, where the pallet receiving container has guide plates with rollers, the pallet does require side rollers since the roller in combination with the guide plate guide the skids of the small container.

FIGS. 8B and 8C shows the right side B and the left side C respectively in detail.

Figure 8D:
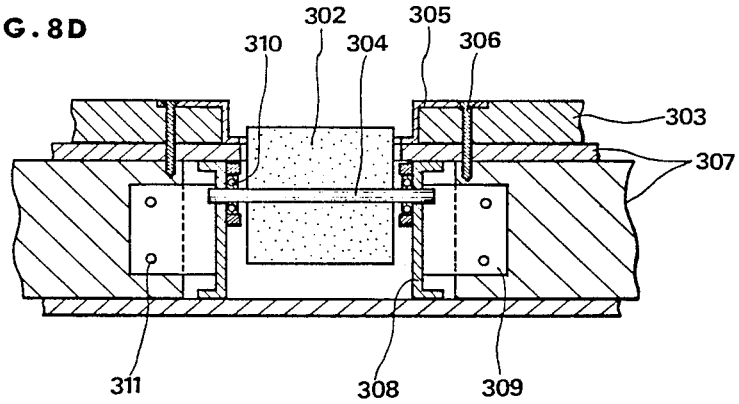
FIG. 8D shows a section taken along the line A—A' in FIG. 8B.

The structure as shown in FIG. 8B is constructed by positioning the skid receiving groove 305 or wheel receiving groove 301 in the pallet supporting floor 303 and I-shaped transverse member 307 in FIG. 8D together by penetrating them with self tapping screws 306 at both sides of skid receiving groove 305 of metal material, of which skid receiving groove 305 the corresponding sections to the protrusions of rollers 302 are cut out, after cutting the pallet supporting floor 303 to have certain breadth with the wood plate maintained longitudinally in spaced relationship corresponding to the spaced relationship of a pair of the rolling pads shown in FIG. 7.

The each skid receiving groove is slightly larger in width than the width of the respective pallet skid such that in use the pallet skid is slidably received and receptively guided into first and second skid receiving groove, respectively, formed in the pallet supporting floor of the pallet receiving container. This enables a guided reception of the pallet into the pallet receiving container and also preventing lateral movement of the platform of the pallet relative to the floor when the pallet skids have been received into the skid receiving grooves.

The installation method of the rollers 302 is described in detail with reference to FIG. 8D, which shows the section taken along the line A—A in FIG. 8B.

Between the transverse members 307 of the I-shaped members which is the bottom member of the pallet receiving container, a pair of channel shaped shaft support 308 of metal is inserted, one end of the fixing piece 309 in the form of channel fixing the shaft support 308 is welded to a surface of the shaft support 308 and another end is bolted to the web of the transverse member 307, so that each member can be separated by disassembling the bolt when needed.

A bearing 310 is installed around the hole formed in the shaft support 308 and a roller shaft 304 integrally fitted with the roller 302 is inserted into the bearing, the roller 302 being rotated with a portion of the upper part projected above the transverse member 307.

As described above, in the pallet receiving container the bottom of which is provided with the roller 302 and the skid receiving groove 305, the pallets or a number of small containers provided with the pallets can be loaded as shown in FIG. 7.

On the other hand, because the structure shown in FIG. 8C being different from FIG. 8B is provided with only the guide plate 301 in the form of a channel, not being provided with the roller, they are employed in loading the pallets provided with the bottom rollers or the small containers provided with such pallets.

As described above, the present invention of the pallet, the small container and the pallet receiving container makes easy the operation of loading and drawing a plurality of the small containers and the pallets into and out of the pallet receiving container due to the transfer device such as the bottom roller and the side roller and the automatic connection device, and also reduces the operation tine and presents the effect of preventing the damage to the pallet receiving container.

The foregoing description of the preferred embodiments has been presented for the purpose of illustration and description. It is not intended to limit the scope of this.

What is claimed is:

1. A pallet comprising:

a platform for supporting articles thereon and having a top, a bottom and a first, a second, a third and a fourth side with said first and third sides and said second and fourth sides being parallel relative to each other to define a four sided platform;

a first and a second forklift tine receiving channel disposed at at least one of said first, third, or fourth sides of said platform for receiving in use the tines of a forklift to enable movement of said pallet by a forklift;

a plurality of horizontal surface engaging wheels disposed on said bottom of said platform for supporting in use said platform and articles placed thereon and for enabling in use said platform to be moved along a horizontal surface upon rotation of said plurality of horizontal surface engaging wheels;

a plurality of vertical surface engaging rollers disposed on said first and said third sides of said platform for preventing in use frictional engagement of said first and said second sides of said platform with a vertical surface upon rotation of said rollers upon contact with said vertical surface thereby enhancing movement of said platform in said horizontal plane when said vertical surface engaging rollers engage said vertical surface;

an automatic connecting and retracting means positioned at said second side of said platform for enabling in use an automatic retraction upon contact of said automatic connecting and retracting means with a wall when manipulating said second side of said pallet against said wall to aid in preventing damage to said wall and said automatic connecting and retracting means and to further enable said second side of said pallet to be moved flat against said wall; and a coupling means positioned at said fourth side of said platform for enabling in use an automatic interconnection of said pallet with a second pallet having an automatic connecting and retracting means operatively positioned thereon to automatically interconnect with said coupling means of said pallet upon contact with said automatic connecting and retracting means of said second pallet to enable thereafter simultaneous movement of said pallets along said horizontal plane.

2. The pallet of claim 1 further including an enclosed container box positioned on and secured to said top of said platform for receiving and protecting in use said articles positioned within said container box.

3. A pallet comprising:

a platform for supporting articles thereon and having a top, a bottom and a first, a second, a third and a fourth side with said first and third sides and said second and fourth sides being parallel relative to each other to define a four sided platform;

a first and a second forklift tine receiving channel disposed at at least one of said first, third, or fourth sides of said platform for receiving in use the tines of a forklift to enable movement of said pallet by a forklift;

a plurality of horizontal surface engaging wheels disposed on said bottom of said platform for supporting in use said platform and articles placed thereon and for enabling in use said platform to be moved along a horizontal surface upon rotation of said plurality of horizontal surface engaging wheels;

a plurality of vertical surface engaging rollers disposed on said first and said third sides of said platform for preventing in use frictional engagement of said first and said second sides of said platform with a vertical surface upon rotation of said rollers upon contact with said vertical surface thereby enhancing movement of said platform in said horizontal plane when said vertical surface engaging rollers engage said vertical surface;

an automatic connecting and retracting means positioned at said second side of said platform for enabling in use a retraction of said automatic connecting and retracting means thereby aiding in preventing damage to both said automatic connecting and retracting means of said platform and said vertical surface by said automatic connecting and retracting means upon contact of said automatic connecting and retracting means with said vertical surface, wherein said automatic connecting and retracting means comprises:

a pair of support plates spaced apart relative to each other and secured to said bottom of said platform;

a connection member having a first end and a second end with an elongated aperture formed between said first and said second ends;

said connection member being positioned between said support plates and pivotally and slidably secured to each said support plates through said aperture such that in use said connection member may pivot and slide along said elongated aperture relative to said support plates;

said first end of said connection member defining a hook having an inclined face; and said connection member extending beyond said platform and being biased in a upward direction and in an outward direction relative to said platform thereby enabling in use retracting of said connection member to aid in preventing damage to both said connection member and a vertical surface by said connection member upon contact of said first end of said connection member with said vertical surface; and a coupling means positioned at said fourth side of said platform for enabling in use an interconnection of said pallet with a second pallet having an automatic connecting and retracting means operatively positioned thereon to interconnect with said coupling means of said pallet upon contact with said automatic connecting and retracting means of said second pallet to enable simultaneous movement of said pallets along said horizontal plane, said coupling means comprises:

a joint projection having an inclined face for slidably receiving said inclined face of said hook and a back portion for securely receiving in use said hook;

a vertical movement stopper secured to said bottom of said platform such that in use vertical movement of said connection member is limited thereby vertically aligning said connection member with said joint projection; and said joint projection extends downwardly relative to said bottom of said second platform with said joint projection being secured to the bottom of said second platform such that in use said inclined face of said hook contacts said inclined face of said joint projection and slidably pivots downwardly along said inclined face of said joint projection to said back of said joint projection whereupon said connection member pivots upwardly to securely interconnect said pallet with a second pallet to enable simultaneous movement of said pallets along said horizontal plane.

4. A pallet comprising:

a platform for supporting articles thereon and having a top, a bottom and a first, a second, a third and a fourth side with said first and third sides and said second and fourth sides being parallel relative to each other to define a four sided platform;

a first and a second forklift tine receiving channel disposed at at least one of said first, third, or fourth sides of said platform for receiving in use the tines of a forklift to enable movement of said pallet by a forklift;

a plurality of horizontal surface engaging wheels disposed on said bottom of said platform for supporting in use said platform and articles placed thereon and for enabling in use said platform to be moved along a horizontal surface upon rotation of said plurality of horizontal surface engaging wheels;

a plurality of vertical surface engaging rollers disposed on said first and said third sides of said platform for preventing in use frictional engagement of said first and said second sides of said platform with a vertical surface upon rotation of said rollers upon contact with said vertical surface thereby enhancing movement of said platform in said horizontal plane when said vertical surface engaging rollers engage said vertical surface;

an automatic connecting and retracting means positioned at said second side of said platform for enabling in use a retraction of said automatic connecting and retracting means thereby aiding in preventing damage to both said automatic connecting and retracting means of said platform and said vertical surface by said automatic connecting and retracting means upon contact of said automatic connecting and retracting means with said vertical surface, wherein said automatic connecting and retracting means comprises:

a "U" shaped support plate secured to said bottom of said platform said "U" shaped support plate having a first leg and a second leg spaced apart relative to each other;

said "U" shaped support plate further including a first section and a second section;

a "T" shaped connection member having a body portion and an arm, with said body portion of said "T" shaped connection member being positioned between said first and second legs of said "U" shaped member and with said arm extending to contact each said first and second legs such that in use the distance said legs are spaced apart is less than the length of said arm thereby limiting entry of said "T" shaped connection member between said first and second legs of said "U" shaped member;

said body portion of said "T" shaped connection member having a terminal end defining a hook having an inclined face; and said "T" shaped connection member being biased in a upward direction and in an outward direction relative to said platform thereby enabling in sue retracting of said "T" shaped connection member to aid in preventing damage to both said "T" shaped connection member and said vertical surface by said "T" shaped connection member upon contact of said terminal end of said "T" shaped connection member with a vertical surface; and a coupling means positioned at said fourth side of said platform for enabling in use an interconnection of said pallet with a second pallet having an automatic connecting and retracting means operatively positioned thereon to interconnect with said coupling means of said pallet upon contact with said automatic connecting and retracting means of said second pallet to enable simultaneous movement of said pallets along said horizontal plane, and wherein said coupling means comprises:

a joint piece pivotally secured to said fourth side of said second platform with said joint piece having an inclined face for slidably receiving said inclined face of said hook and a back for securely receiving in use said hook;

said first and said second sections of said "U" shaped member each further including a first and a second vertical movement stopper, respectively for limiting the upward vertical movement of said "T" shaped member thereby vertically alilgning said "T" shaped connection member with said joint piece; and said joint piece extends downwardly relative to said bottom of said second platform such that in use when said inclined face of said hook contacts said inclined face of said joint piece said joint piece pivots and slides along said inclined face of said hook to said back of said hook whereupon said joint piece pivots downwardly to securely interconnect said pallet with said second pallet to enable simultaneous movement of said pallets along aid horizontal plane.

5. A pallet comprising:

a platform for supporting articles thereon and having a top, a bottom and a first, a second, a third and a fourth side with said first and third sides and said second and fourth sides being parallel relative to each other to define a four sided platform;

a first and a second forklift tine receiving channel disposed at at least one of said first, third or fourth sides of said platform for receiving in use the tines of a forklift to enable movement of said pallet by a forklift;

an automatic connecting and retracting means positioned at said second side of said platform for enabling in use an automatic retraction upon contact of said automatic connecting and retracting means with a wall when manipulating said second side of said pallet against said wall to aid in preventing damage to said wall and said automatic connecting and retracting means and to further enable said second side of said pallet to be moved flat against said wall; and a coupling means positioned at said fourth side of said platform for enabling in use an automatic interconnection of said platform with a second pallet having an automatic connecting and retracting means operatively positioned thereon to automatically interconnect with said coupling means of said pallet upon contact with said automatic connecting and retracting means of said second pallet to thereafter enable simultaneous movement of said pallets along said horizontal plane.

6. The pallet of claim 5 further including an enclosed container box positioned on and secured to said top of said platform for receiving and protecting in use said articles positioned within said container box.

7. A pallet comprising:

a platform for supporting articles thereon and having a top, a bottom and a first, a second, a third and a fourth side with said first and third sides and said second and fourth sides being parallel relative to each other to define a four sided platform;

a first and a second forklift tine receiving channel disposed at at least one of said first, third or fourth sides of said platform for receiving in use the tines of a forklift to enable movement of said pallet by a forklift;

an automatic connecting and retracting means positioned at said second side of said platform for enabling in use a retraction of said automatic connecting and retracting means thereby aiding in preventing damage to both said automatic connecting and retracting means of said platform and said vertical surface by said automatic connecting and retracting means upon contact of said automatic connecting and retracting means with said vertical surface, wherein said automatic connecting and retracting means comprises:

a pair of support plates spaced apart relative to each other and secured to said bottom of said platform;

a connection member having a first end and a second end with an elongated aperture formed between said first and said second ends;

said connection member being positioned between said support plates and pivotally and slildably secured to each said support plates through said aperture such that in use said connection member may pivot and slide along said elongated aperture relative to said support plates;

said first end of said connection member defining a hook having an inclined face; and said connection member extending beyond said platform and being biased in a upward direction and in an outward direction relative to said platform thereby enabling in use retraction of said connection member to aid in preventing damage to both said connection member and a vertical surface by said connection member upon contact of said first end of said connection member with said vertical surface; and a coupling means positioned at said fourth side of said platform for enabling in use an interconnection of said platform with a second pallet having an automatic connecting and retracting means operatively positioned thereon to interconnect with said coupling means of said pallet upon contact with said automatic connecting and retracting means of said second pallet to enable simultaneous movement of said pallets along said horizontal plane, wherein said coupling means comprises:

a joint projection having an inclined face for slidably receiving said inclined face of said hook and a back portion for securely receiving in use said hook;

a vertical movement stopper secured to said bottom of said platform such that in use vertical movement of said connection member is limited thereby vertically aligning said connection member with said joint projection; and said joint projection extends downwardly relative to said bottom of said second platform with said joint projection being secured to the bottom of said second platform such that in use said inclined face of said hook contacts said inclined face of said joint projection and slidably pivots downwardly along said inclined face of said joint projection to said back of said joint projection whereupon said connection member pivots upwardly to securely interconnect said platform with said second pallet to enable simultaneous movement of said pallets along said horizontal plane.

8. A pallet comprising:

a platform for supporting articles thereon and having a top, a bottom and a first, a second, a third and a fourth side with said first and third sides and said second and fourth sides being parallel relative to each other to define a four sided platform;

a first and a second forklift tine receiving channel disposed at at least one of said first, third or fourth sides of said platform for receiving in use the tines of a forklift to enable movement of said pallet by a forklift;

an automatic connecting and retracting means positioned at said second side of said platform for enabling in use a retraction of said automatic connecting and retracting means thereby aiding in preventing damage to both said automatic connecting and retracting means ofr said platform and said vertical surface by said automatic connecting and retracting means upon contact of said automatic connecting and retracting means with said vertical surface, wherein said automatic connecting and retracting means comprises:

a pair of suport plates spaced apart relative to each other and secured to said bottom of said platform with said suport plates having a first section and a second section;

a "T" shaped connection member having a body portion and an arm portion with said body portion of said "T" shaped connection member being positioned between said support plates and with said arm portion extending to contact each of said supporting plates such that in use the distance said support plates are spaced apart is less than the length of said horizontal bar thereby limiting entry of said "T" shaped connection member between said support plates;

said body portion of said "T" shaped connection member having a terminal end defining a hook having an inclined face; and said "T" shaped connection member being biased in a upward direction and in an outward direction relative to said platform thereby enabling in use retraction of said "T" shaped connection member to aid in preventing damage to both said "T" shaped connection member and said vertical surface of said "T" shaped connection member upon contact of said terminal end of said "T" shaped connection member with a vertical surface; and a coupling means positioned at said fourth side of said platform for enabling in use an interconnection of said platform with a second pallet having an automatic connecting and retracting means operatively positioned thereon to interconnect with said coupling means of said pallet upon contact with said automatic connecting and retracting means of said second pallet to enable simultaneous movement of said pallets along said horizontal plane, wherein said coupling means comprises:

a joint piece pivotally secured to said fourth side of said second platform with said joint piece having an inclined face for slidably receiving said inclined face of said hook and a back for securely receiving in use said hook; said first and said second sections of said support plates each further including a first and a second vertical movement stopper, respectively for limiting the vertical movement of said "T" shaped member thereby vertically aligning said "T" shaped connection member with said joint piece; and said joint piece extends downwardly relative to said bottom of said second platform such that in use when said inclined face of said hook contacts said inclined face of said joint piece said joint piece pivots and slides along said inclined face of said hook to said back of said hook whereupon said joint piece pivots downwardly to securely interconnect said platform with said second pallet to enable simultaneous movement of said pallets along said horizontal plane.

9. A pallet system, comprising:

a pallet, comprising a platform for supporting articles thereon and having a top, a bottom and a first, a second, a third and a fourth side with said first and third sides and said second and fourth sides being parallel relative to each other to define a four sided platform;

a plurality of horizontal surface engaging wheels disposed on said bottom of said platform along a line parallel to the first side of said platform and along a line parallel to the third side of said platform for supporting in use said platform and articles placed thereon and for enabling in use said platform to be moved along a horizontal surface only in a straight line motion upon rotation of said plurality of horizontal surface engaging wheels;

a first and a second forklift tine receiving channel disposed at at least one side of said platform of said pallet for receiving in use the tines of a forklift to enable movement of said pallet by a forklift; and a pallet receiving container, wherein said pallet receiving container comprises a supporting floor having a first and a second pallet wheel receiving groove, respectively, formed in said pallet supporting floor in a parallel and spaced apart manner relative to one another such that in use said plurality of horizontal surface engaging wheels disposed on said bottom of said platform along said line parallel to said first side of said platform and along said line parallel to said third side of said platform are each guidably received into said first and second pallet wheel receiving groove formed in said pallet supporting floor of said pallet receiving container, respectively, thereby preventing lateral movement of said platform relative to said floor when said plurality of horizontal surface engaging wheels have been received into said first and said second pallet wheels receiving grooves.

10. The pallet system of claim 9 further including an enclosed container box positioned on and secured to said top of said platform for receiving and protecting in use said articles positioned within said container box.

11. A pallet system, comprising:

a first pallet comprising a platform for supporting articles thereon and having a top, a bottom and a first, a second, a third and a fourth side with said first and third sides and said second and fourth sides being parallel relative to each other to define a four sided platform;

a first and a second forklift tine receiving channel for receiving in use the tines of a forklift disposed at at least one side of said platform;

a first and a second pallet skid with each said skid being parallel and spaced apart relative to one another and with said first and said second skid positioned on said bottom of said platform for supporting in use said platform and articles placed thereon;

an automatic connecting and retracting means positioned at said second side of said platform for enabling in use a retraction of said automatic connecting and retracting means thereby aiding in preventing damage to both said automatic connecting and retracting means of said platform and said vertical surrface by said automatic connecting and retracting means upon contact of said automatic connecting and retracting means with said vertical surface; and a pallet receiving container for receiving in use a plurality of pallets, wherein said pallet receiving container comprises a supporting floor having a first and a second pallet skid receiving groove, respectively, formed in said pallet supporting floor;

each said skid receiving groove being slightly larger in width than the width of each said pallet skid such that in use each said pallet skid is slidably received and receptively guided into said first and said second skid receiving groove, respectively, formed in said pallet supporting floor of said pallet receiving container thereby preventing lateral movement of said platform relative to said floor when said pallet skids have been received into said skid receiving grooves; and a coupling means positioned at said fourth side of said platform for enabling in use an interconnection of said first pallet with a second pallet having an automatic connecting and retracting means operatively positioned thereon to interconnect with said coupling means of said first pallet upon contact with said automatic connecting and retracting means of said second pallet to enable simultaneous movement of said pallets along said pallet supporting floor of said pallet receiving container.

12. The pallet system of claim 11, wherein each said skid receiving groove is provided with a plurality of rollers for rotatably supporting in use said first and said second skids respectively and for aiding in use said platform to be moved along a horizontal surface of said pallet supporting floor upon rotation of said plurality of rollers.

13. The pallet system of claim 11 further including an enclosed container box positioned on and secured to said top of said platform for receiving and protecting in use said articles positioned within said container box.

14. The pallet system of claim 11 wherein said automatic connecting and retracting means comprises:

a pair of support plates spaced apart relative to each other and secured to said bottom of said platform;

a connection member having a first end and a second end with an elongated aperture formed between said first and said second ends;

said connection member being positioned between said support plates and pivotally and slidably secured to each said support plates through said aperture such that in use said connection member may pivot and slide along sain elongated aperture relative to said support plates;

said first end of said connection member defining a hook having an inclined face;

said connection member extending beyond said platform and being biased in a upward direction and in an outward direction relative to said platform thereby enabling in use retraction of said connection member to aid in preventing damage to both said connection member and a vertical surface by said connection member upon contact of said first end of said connection member with said vertical surface;

said coupling means comprises a joint projection having an inclined face for slidably receiving said inclined face of said hook and a back portion for securely receiving in use said hook; and a vertical movement stopper secured to said bottom of said platform such that in use vertical movement of said connection member is limited thereby vertically aligning said connection member with said joint projection;

said joint projection extends downwardly relative to said bottom of said second platform with said joint projection being secured to the bottom of said second platform such that in use said inclined face of said hook contacts said inclined face of said joint projection and slidably pivots downwardly along said inclined face of said joint projection to said back of said joint projection whereupon said connection member pivots upwardly to securely interconnect said platform with a second pallet to enable simultaneous movement of said pallets along said horizontal plane.

15. The pallet system of claim 11 wherein said automatic connecting and retracting means comprises:

a pair of support plates spaced apart relative to each other and secured to said bottom of said platform with said support plates having a first section and a second section;

a "T" shaped connection member having a body portion and an arm portion with said body portion of said "T" shaped connection member being positioned between said support plates and with said arm portion extending to contact leach said supporting plates such that in use the distance said support plates are spaced apart is less than the length of said horizontal bar thereby limiting entry of said "T" shaped connection member between said support plates;

said body portion of said "T" shaped connection member having a terminal end defining a hook having an inclined face;

said "T" shaped connection member being biased in a upward direction and in an outward direction relative to said platform thereby enabling in use retraction of said "T" shaped connection member to aid in preventing damage to both said "T" shaped connection member and said vertical surface by said "T" shaped connection member upon contact of said terminal end of said "T"shaped connection member with a vertical surface;

said coupling means comprises a joint piece pivotally secured to said fourth side of said second platform with said joint piece having an inclined face for slidably receiving said inclined face of said hook and back for securely receiving in use said hook; said first and said second sections of said support plates each further including a first and a second vertical movement stopper, respectively for limiting the vertical movement of said "T" shaped member thereby vertically aligning said "T" shaped connection member with said joint piece; and said joint piece extends downwardly relative to said bottom of said second platform such that in use when said inclined face of said hook contacts said inclined face of said joint piece said joint piece pivots and slides along said inclined face of said hook to said back of said hook whereupon said joint piece pivots downwardly to securely interconnect said pallet with said second pallet to enable simultaneous movement of said pallets along said horizontal plane.

* * * * *